US006108866A

United States Patent [19]

Waynick, Jr.

[11] Patent Number: 6,108,866

[45] **Date of Patent: *Aug. 29, 2000**

[54] DETENT MECHANISM FOR A VEHICLE DOOR

[75] Inventor: Walter A. Waynick, Jr., Ray Township, Mich.

[73] Assignee: Chrysler Corporation, Auburn Hills, Mich.

[ * ] Notice: This patent is subject to a terminal disclaimer.

[21] Appl. No.: 09/182,851

[22] Filed: Oct. 29, 1998

[51] Int. Cl.[7] ..... E05F 5/02

[52] U.S. Cl. ..... 16/82; 16/374

[58] Field of Search ..... 16/82, 83, 371, 16/374, 377, 86 R, 86 A, 86 B, DIG. 17

[56] References Cited

U.S. PATENT DOCUMENTS

| | | | |
|---|---|---|---|
| 2,905,965 | 9/1959 | Flint . | |
| 3,550,187 | 12/1970 | Swartz | 16/278 |
| 4,719,665 | 1/1988 | Bell . | |
| 4,720,895 | 1/1988 | Peebles . | |
| 4,794,669 | 1/1989 | Sanders . | |
| 4,864,687 | 9/1989 | Calcaterra et al. . | |
| 4,891,862 | 1/1990 | Holan | 16/334 |
| 5,067,201 | 11/1991 | Marchione . | |
| 5,297,314 | 3/1994 | Bender et al. . | |
| 5,546,633 | 8/1996 | Liu . | |
| 5,644,817 | 7/1997 | Bender et al. . | |
| 5,661,875 | 9/1997 | Overcash et al. | 16/82 |
| 5,692,264 | 12/1997 | Van Der Steur | 16/82 |
| 5,724,683 | 3/1998 | Sorimachi et al. . | |
| 5,924,170 | 7/1999 | Papke et al. | 16/82 |

*Primary Examiner*—Chuck Y. Mah
*Attorney, Agent, or Firm*—Marc Lorelli

[57] ABSTRACT

A resilient detent mechanism for selectively maintaining a vehicle door in the open position is provided. The detent mechanism including a hinge pin receptacle adapted to allow insertive mounting with a door hinge by engagement with a hinge pin of the door hinge. The detent mechanism also includes a planar side surface to contact both the stationary and pivotal components of the door hinge. The detent also includes a working corner portion that contacts a portion of the door hinge and tends to maintain the vehicle door in the open position. The contact between the working corner portion and the stationary component of the door hinge can be overcome by a sufficient door closing effort.

10 Claims, 3 Drawing Sheets

DETENT MECHANISM FOR A VEHICLE DOOR

BACKGROUND OF THE INVENTION

1. Technical Field

The present invention generally relates to an apparatus for selectively securing a vehicle door in the open position. More particularly, the present invention relates to a detent mechanism for use in a paint shop of an assembly plant to secure a vehicle door in the open position when needed for painting purposes.

2. Discussion

An automotive assembly plant is generally separated into three centers: body, paint, and assembly. The body center is where the sheet metal is combined together to produce a structure for the vehicle. This structure, or body, is then transported into the paint center. The paint center includes a number of sequenced steps including the application of base coat, E-coat, heat treatment and clear coat. After the body has been painted it is sent to the assembly center. The assembly center is where all remaining parts are attached to the painted body.

In the paint center, the doors of a vehicle must open and close numerous times in order to facilitate the proper painting of a vehicle. For example, the doors must be remain open in order to paint the inner portion of the door and the doors must be closed when painting the exterior portion of the door and the remainder of the vehicle exterior. In order to accomplish this task, a mechanism is utilized to keep the doors open but allows the door to close when this is desirable.

An assembled vehicle has doors that are kept open by means of door check strap or the like attached to both the doors and the body of a vehicle to provide the doors with a number of possible detents. These detents provide the door the ability to maintain a number of different open positions when desired by the operator of the vehicle. Vehicles are normally outfitted with door check straps in the assembly center subsequent to painting. A typical door check strap is comprised of materials that could not withstand the heat and processing steps in the paint shop, and, therefore, cannot be installed earlier in the vehicle construction. In addition, placement of a check strap on the vehicle creates shadowing which is discussed in detail below.

The need for a door open device has led many manufactures to install temporary metallic check straps on each vehicle before it enters the paint shop. This creates a number of problems. First, the cost of a metallic check strap is so high that it must be reused. Furthermore, the metallic check strap must be cleaned after every use to remove paint, thus adding even more cost to the scenario. Another problem is that the metallic check strap interferes with the path of paint sprayed towards the door inner panel. Hence, the metallic check strap will cause shadowing where paint is not uniformly applied and that can lead to customer dissatisfaction. Shadowing is defined as an area that does not receive sufficient paint or other coating due to an obstruction of the spray path.

SUMMARY OF THE INVENTION

Accordingly, it is a principal objective of the present invention to provide an insertable detent mechanism for selectively securing a vehicle door in the open position in a paint shop of a vehicle assembly plant. It is another objective to provide a cost effective method for providing an detent mechanism for keeping a vehicle door open in a paint shop of a manufacturing facility. It is yet another objective of the present invention to provide a detent mechanism for keeping a vehicle door open in a paint shop that limits shadowing on the door inner. It is a further objective of the invention to provide a detent mechanism that establishes a detent for the door open position, but allows for door closure without removal of the detent mechanism.

In one form, the present invention provides an insertable detent mechanism to selectively secure a vehicle door in an open position. The detent mechanism includes a hinge pin receptacle which engages a hinge pin. The detent mechanism also includes a side surface which contacts both the stationary and the pivotal components of a door hinge assembly. The side surface also includes a working portion, which contacts the door hinge tending to maintain the vehicle door in the open position. The contact of the detent portion with the door hinge can also be overcome by a door closing effort so that the door can be closed when needed.

Additional benefits and advantages of the present invention will become apparent to those skilled in the art to which this invention relates from a reading of the subsequent description of the preferred embodiment and the appended claims, taken in conjunction with the accompanying drawings.

DETAILED DESCRIPTION OF THE PREFERRED EMBODIMENT

Figure 2:
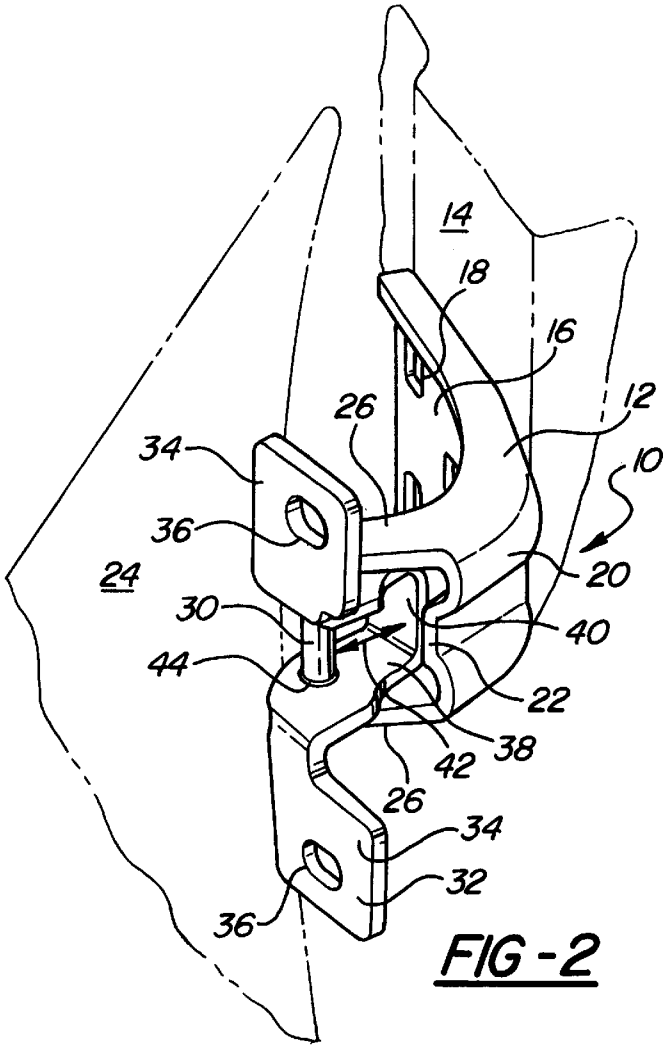
FIG. 2 is a perspective view illustrating the door hinge in the door open position.
Figure 1:
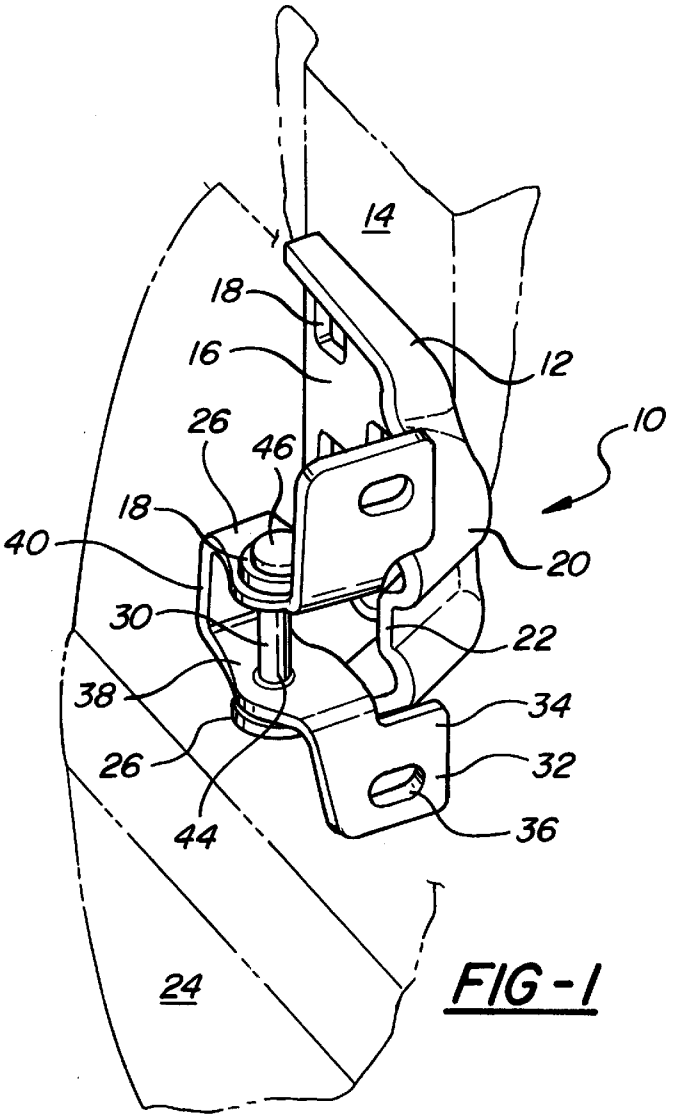
FIG. 1 is a perspective view illustrating a door hinge in the door closed position.

Turning first to the perspective view of FIG. 1, a door hinge 10 is illustrated in its closed position. Door hinge 10 includes a stationary component 12 that is attached to a vehicle body 14. Stationary component 12 includes a coupling plate 16 with a plurality of apertures 18 adapted for attachment to vehicle body 14 via bolts 15 shown in FIG. 4. Stationary component 12 also includes a structural projection 20 that extends outboard of coupling plate 16 which terminates in a stationary edge 22. Referring to FIG. 2, door hinge 10 is illustrated in its opened position. Note that the edge 22 acts to limit the angle at which door 24 can open. Extending from structural projection 20 are two fingers 26 each with an opening 28 for receiving a hinge pin 30.

Figure 4:
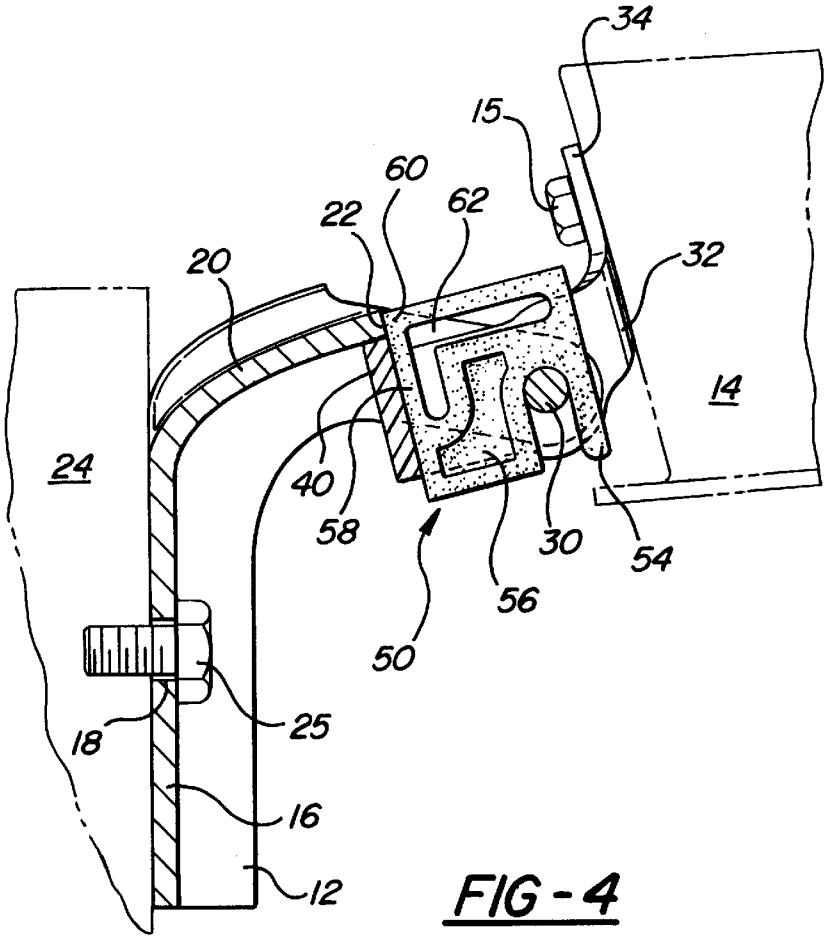
FIG. 4 is a cross sectional planar view of the detent mechanism installed onto the door hinge while the door is in the open position.

Door hinge 10 also includes a complementary pivotal component 32 attached to vehicle door 24. Pivotal component 32 is provided with two base formations 34 each having a hole 36 adapted for attached to vehicle door 24 via bolts 25, as shown in FIG. 4. A horseshoe shaped formation 38 connects the two base formations 36 together and includes a bottom wall 40 located a specific distance 42 from the hinge pin 30. Pivotal component 32 includes two aligned openings 44 for receiving hinge pin 30.

Hinge pin 30 includes an enlarged end cap portion 46 attached at the top end as seen in FIG. 1. Hinge pin extends through opening 28 of upper finger 26 and through opening 44 of the upper portion of pivotal component 32. Hinge pin 30 than extends downward through opening 44 on the lower portion of pivotal component 32 and through the lower opening 28 on the lower finger 26. Hinge pin 30 terminates in another enlarged end cap (Not visible) substantially similar to the upper end cap 46 on the top end of hinge pin 30.

Pivotal component 32 is mounted about hinge pin 30 and is adapted to provide a means to pivot door 24 from a closed position as seen in FIG. 1 to an open position as seen in FIG. 2. As can be understood by the view in FIG. 2, when door 24 is completely open, the bottom wall 40 of horseshoe shaped formation 38 contacts stationary edge 22 to limit the extent to which door 24 can pivot past its fully opened position.

Figure 3:
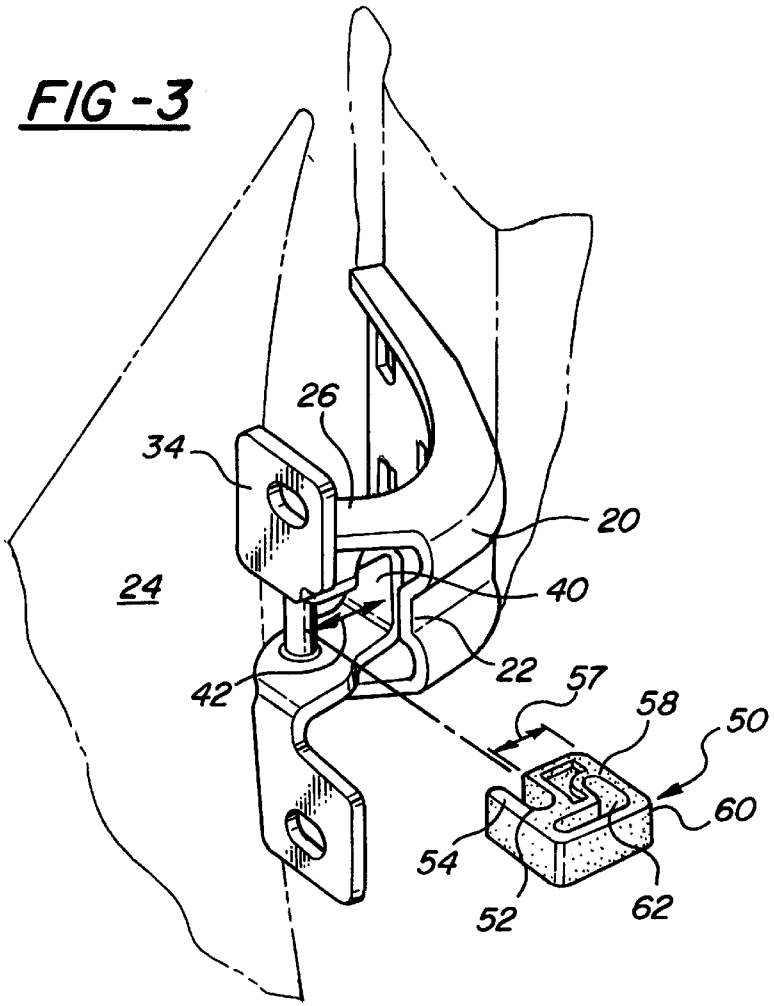
FIG. 3 is a perspective view illustrating the door hinge in the door open position showing the insertion of a detent mechanism.

Turning now to the perspective view of FIG. 3, an insertable detent mechanism 50 is shown for selectively maintaining door 24 in the opened position. Detent Mechanism 50 is readily insertable and removable. Detent mechanism 50 is shown prior to installation with door hinge 10. The installation of detent mechanism 50 occurs while door 24 is in the open position as this allows for ease of processing within a manufacturing facility. While door 24 is in the open position, installation of detent mechanism 50 will not restrict the path of paint spray onto door 24, thereby alleviating any problem shadowing as discussed previously.

Detent mechanism 50 is made of 33% fiberglass material and the balance is comprised of a nylon material. Detent mechanism 50 includes a hinge pin receptacle channel 52 adapted to receive hinge pin 30 as best shown in FIGS. 3 and 4. Hinge pin receptacle 52 is formed by an arm portion 54 that can be cantilevered during installation to form a tight fit of hinge pin 30 into hinge pin receptacle 52 and a wedge portion 56 which extends from hinge pin receptacle 52 to a planar side surface 58. Wedge portion 56 has a width 57 substantially equal to the specified distance 42 defined earlier. This deign insures that the detent mechanism 50 fits snugly between hinge pin 30 and wall 40 so that it will pivot with pivotal component 32 as the hinge pivots.

Figure 6:
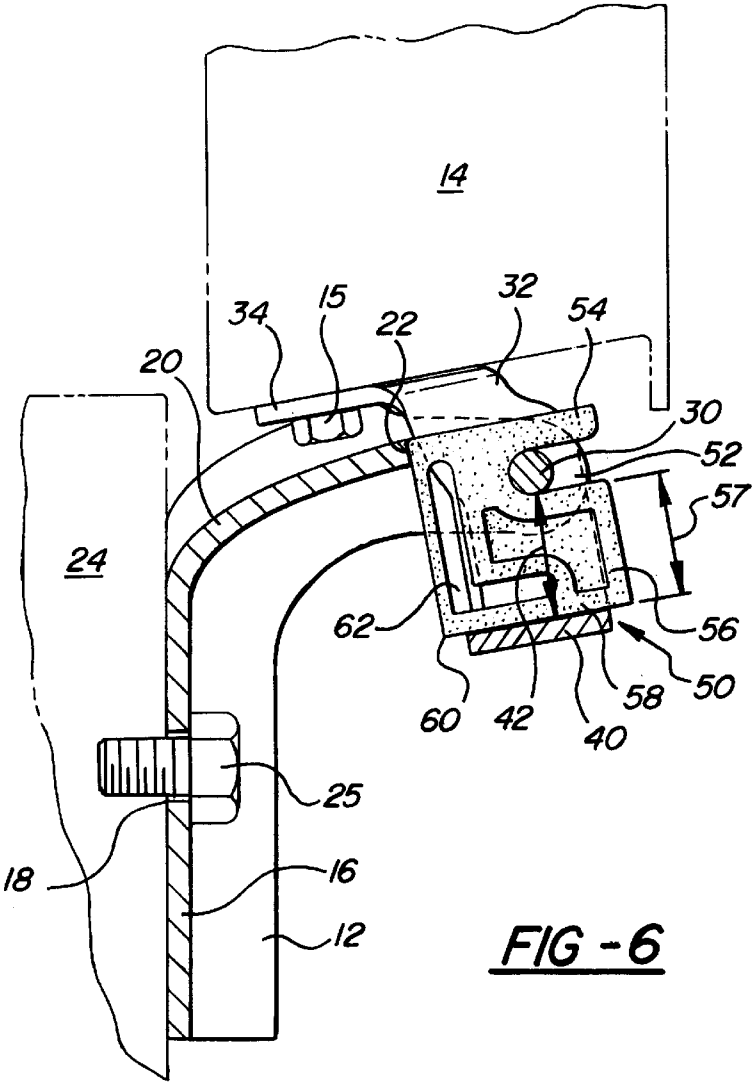
FIG. 6 is a cross sectional planar view of the detent mechanism installed onto the door hinge while the door is in the closed position.
Figure 5:
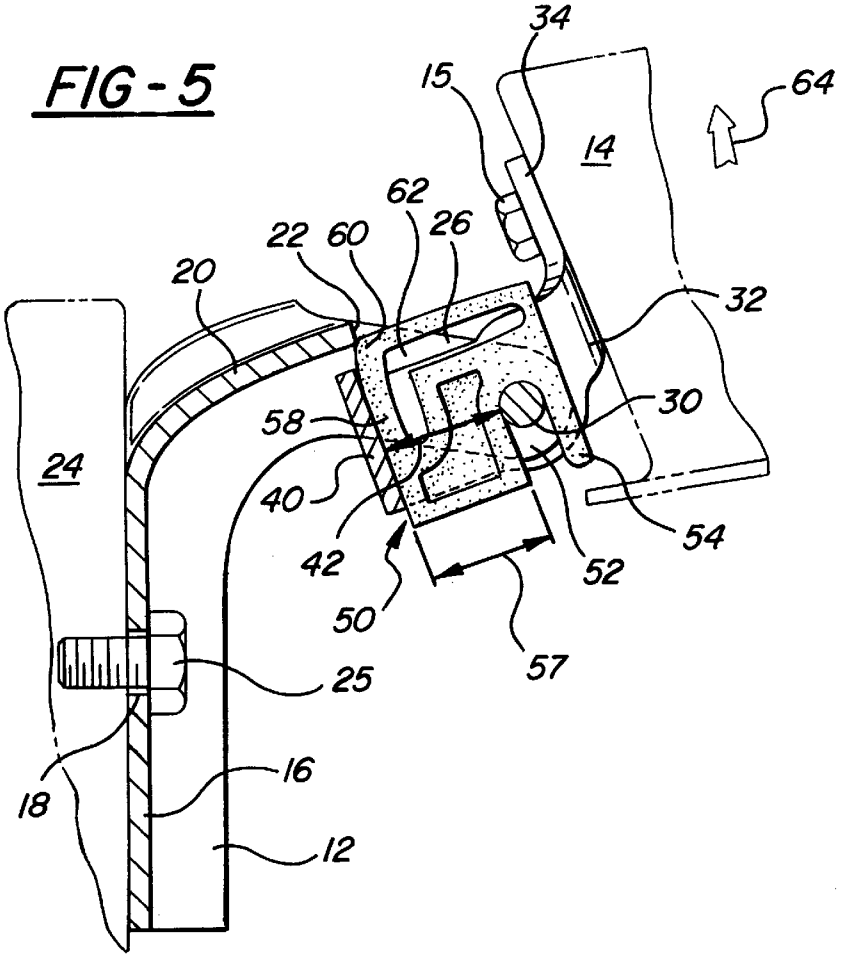
FIG. 5 is a cross sectional planar view of the detent mechanism installed onto the door hinge while the door is transitioning between the open position and the closed position.

Planar side surface 58, as been shown in FIG. 4, is adapted to contact both bottom formation 40 of horseshoe formation 38 and stationary edge 22 of stationary component 12. Planar side surface 58 includes a working corner portion 60 that contacts stationary component 12 wherein this contact tends to maintain door 24 in the open position. Detent mechanism 50 includes a hole 62 therethough disposed near working portion 60 to provide a degree of flexibility to working corner potion 60 allowing it to disengage from stationary edge 22, permitting the door to be closed in response to a sufficient door closing effort. This action is best shown in FIG. 5, in which it can be seen that working corner portion 60 gives slightly to allow pivotal component 32 to rotate about hinge pin 30 while closing the door 24. As is shown in FIGS. 5 and 6, detent mechanism 50 moves with pivotal component 52 as it pivots due to the tight fit between wedge portion 56, and hinge pin 30, and bottom wall 40. This tight fit allows for hinge pin 30 to rotate within hinge pin receptacle 52.

One of ordinary skill can appreciate that closing the door 24 while detent mechanism 50 is in place will require a fair amount of force. This force will provide a lock or a detent for the hold-open position to facilitate paint processes that requires door 24 to be in an open position. As shown in FIG. 5, this lock or detent generated hold-open position (FIG. 4) cam be overcome by a closing force 64 on door 24 to facilitate paint processes that require a closed door 24 (FIG. 6). One can also appreciate that door 24 can be moved from the closed position, in FIG. 6, to the opened position in FIG. 4 in a similar manner. Using moderate force in the direction opposite closing force 64, working comer portion 60 can be transitioned (FIG. 5) past stationary edge 22 to the opened position of the door (FIG. 4), wherein interaction between detent mechanism 50 and edge 22 provides a lock or detent for the door open position.

While the above description constitutes the preferred embodiment of the invention, it will be appreciated that the invention is susceptible to modification, variation, and change without departing from the proper scope or fair meaning of the accompanying claims.

What is claimed is:

1. A detent mechanism for use with a door hinge to selectively maintain a vehicle door in the open position, said door hinge having a stationary component attached to a vehicle body and a pivotal component attached to the vehicle door, said stationary component and said pivotal component pivotally connected by a hinge pin, said detent mechanism comprising:

a wedge portion having a width such that said wedge portion is capable of being disposed between the hinge pin and the pivotal component; and a side surface operatively connected to said wedge portion, said side surface adopted to contact both the stationary and pivotal components of the door hinge while said wedge portion is disposed between the hinge pin and the pivotal component, said side surface includes a working portion that contacts the stationary component of the door hinge wherein this contact tends to maintain the vehicle door in the open position and can be overcome by a door closing effort.

2. The invention as set forth in claim 1, further comprising a hinge pin receptacle operatively connected to said wedge portion and adapted to receive the hinge pin.

3. The invention as set forth in claim 1, wherein said detent mechanism includes a hole therethrough, said hole is disposed adjacent to said working portion to impart flexibility and allow for the contact between said working portion and said door hinge to be overcome by door closing effort.

4. The invention as set forth in claim 2, wherein said hinge pin receptacle is a tight fit to ensure a locking arrangement between said detent mechanism and said pivotal component.

5. The invention as set forth in claim 2, wherein said detent mechanism is made of nylon and fiberglass.

6. A system to selectively maintain a vehicle door in the open position, said system comprising:

a door hinge comprising:

a stationary component attached to a vehicle body;

a pivotal component attached to the vehicle door;

a hinge pin pivotally connecting said stationary component and said pivotal component;

an insertable detent mechanism to selectively maintain a vehicle door in the open position comprising:

a hinge pin receptacle adapted to receive said hinge pin; and a planar side surface operatively connected to said hinge pin receptacle, said side surface adopted to contact both said stationary and said pivotal component of the door hinge, said side surface includes a working portion that contacts said stationary component of the door hinge wherein this contact tends to maintain the vehicle door in the open position and can be overcome by door closing efforts.

7. The invention as set forth in claim 6, wherein said binge pin receptacle includes a cantilevered arm to form a tight fit condition between said detent mechanism and said hinge pin.

8. The invention as set forth in claim 6, wherein said pivotal component includes a horseshoe-like formation including a wall located a specific distance from said hinge pin, said horseshoe formation contacts said stationary component when the vehicle door is in the open position.

9. The invention as set forth in claim 8, wherein said detent mechanism includes a wedge portion disposed between said hinge pin receptacle and said planar side surface, said wedge portion having a width substantially equal to the distance between said wall of said horseshoe-like formation and said hinge pin.

10. A system to selectively maintain a vehicle door in the open position, said system comprising:

a door hinge comprising:

a stationary component attached to a vehicle body;

a pivotal component attached to the vehicle door;

a hinge pin pivotally connecting said stationary component and said pivotal component;

said pivotal component including a horseshoe-like formation including a wall spaced a specific distance from said hinge pin, said horseshoe-like formation contacts said stationary component when the vehicle door is in the open position;

an insertable and removable detent mechanism to selectively maintain a vehicle door in the open position comprising:

a hinge pin receptacle adapted to receive said hinge pin;

a planar side surface operatively connected to said hinge pin receptacle, said side surface adopted to contact both said stationary and said horseshoe of said pivotal component of the door hinge, said side surface includes a working corner portion that contacts the stationary component of the door hinge wherein this contact tends to maintain the vehicle door in the open position and the contact can be overcome by a door closing effort;

a wedge portion disposed between said hinge pin receptacle and said planar side surface, said wedge portion having a width substantially equal to the distance between said horseshoe formation of said pivotal component and said hinge pin to ensure a locking arrangement between said pivotal component and said detent mechanism; and wherein said insertable and removable detent mechanism selectively maintains a vehicle door in the open position consists essentially of nylon and fiberglass.

* * * * *